US011845014B2

(12) United States Patent
Ma et al.

(10) Patent No.: US 11,845,014 B2
(45) Date of Patent: Dec. 19, 2023

(54) INTERACTIVE MODULAR CONSTRUCTION ELEMENT AND A MODULAR CONSTRUCTION SYSTEM WITH INTERACTIVE MODULAR CONSTRUCTION ELEMENTS

(71) Applicant: LEGO A/S, Billund (DK)

(72) Inventors: Benjamin Ma, Vejle (DK); Henrik Colfach Sørensen, Egtved (DK); Henrik Engmark Daae, Vejle (DK); James John Norwood, Odense M (DK); Jaime Fabregat Vilella, Billund (DK); Rasmus Bissenbakker Karsgaard, Horsens (DK); Simon James Wiscombe, Vejle (DK); Troels Lange Andersen, Hadsten (DK); Wei Wang, Vejle (DK)

(73) Assignee: LEGO A/S, Billund (DK)

( * ) Notice: Subject to any disclaimer, the term of this patent is extended or adjusted under 35 U.S.C. 154(b) by 431 days.

(21) Appl. No.: 16/486,775

(22) PCT Filed: Mar. 1, 2018

(86) PCT No.: PCT/EP2018/055023
§ 371 (c)(1),
(2) Date: Aug. 16, 2019

(87) PCT Pub. No.: WO2018/158357
PCT Pub. Date: Sep. 7, 2018

(65) Prior Publication Data

US 2020/0179818 A1 Jun. 11, 2020

(30) Foreign Application Priority Data

Mar. 3, 2017 (DK) ..... PA 2017 70155

(51) Int. Cl.
*A63H 33/04* (2006.01)
*A63H 33/08* (2006.01)

(52) U.S. Cl.
CPC ..... *A63H 33/042* (2013.01); *A63H 33/086* (2013.01)

(58) Field of Classification Search
CPC ..... A63H 33/042; A63H 33/086
See application file for complete search history.

(56) References Cited

U.S. PATENT DOCUMENTS 8,354,918 B2 1/2013 Boyer
8,753,164 B2 * 6/2014 Hansen ..... A63H 33/042 446/85

(Continued)

FOREIGN PATENT DOCUMENTS

CN 102137699 A 7/2011
CN 104941216 A 9/2015

(Continued)

OTHER PUBLICATIONS

Chinese Office Action and Search Report issued in corresponding Chinese application No. 201880026362.4, dated Dec. 14, 2020. (Original) (9 pages).

(Continued)

*Primary Examiner* — Eugene L Kim
*Assistant Examiner* — Alyssa M Hylinski
(74) *Attorney, Agent, or Firm* — Day Pitney LLP; Anthony A. Kassas

(57) ABSTRACT

An interactive modular construction element (100) for a modular construction system (200), the interactive modular construction element (100) comprising a sensor (601) being responsive to a predetermined sensor input and adapted to output a sensor signal (610) corresponding to or representing the predetermined sensor input, a function element (602)

(Continued)

adapted to perform at least one controllable function in response to a control signal (611), and a control circuit (603) connected to the sensor (601) to receive the sensor signal (610) and connected to the function element (602) to provide the control signal (611), wherein the control circuit (603) is adapted to provide the control signal (611) in response to the sensor signal (610) thereby controlling the function element (602) in response to the sensor signal (610), wherein the interactive modular construction element (100) comprises an input part (101) and an output part (102), where the input part (101) and the output part (102) are different from each other.

24 Claims, 7 Drawing Sheets

(56) References Cited

U.S. PATENT DOCUMENTS

| | | | | |
|---|---|---|---|---|
| 9,755,356 | B1 * | 9/2017 | Kim | H01R 13/04 |
| 10,625,173 | B2 * | 4/2020 | Kærsgaard | A63H 33/042 |
| 2009/0068923 | A1 * | 3/2009 | Cheng | A63H 3/00 446/268 |
| 2010/0001923 | A1 * | 1/2010 | Zilber | A63F 13/42 345/1.1 |
| 2011/0012661 | A1 * | 1/2011 | Binder | A63H 33/08 307/41 |
| 2012/0218211 | A1 * | 8/2012 | McRae | G06F 1/1684 320/108 |
| 2012/0258436 | A1 * | 10/2012 | Lee | G09B 19/003 434/362 |
| 2012/0268390 | A1 * | 10/2012 | Yang | G06F 1/1675 345/173 |
| 2013/0050958 | A1 * | 2/2013 | Bdeir | H01R 11/30 439/39 |
| 2013/0217294 | A1 * | 8/2013 | Karunaratne | A63H 33/22 446/90 |
| 2014/0127965 | A1 * | 5/2014 | Adam | A63H 33/042 446/91 |
| 2014/0323013 | A1 | 10/2014 | Gonzalez-Heydrich et al. | |
| 2016/0361662 | A1 * | 12/2016 | Karunaratne | G06F 3/038 |
| 2017/0106308 | A1 * | 4/2017 | Wei | A63H 33/042 |
| 2017/0252664 | A1 * | 9/2017 | Cletheroe | A63H 33/046 |

FOREIGN PATENT DOCUMENTS

| | | | | |
|---|---|---|---|---|
| CN | 205883294 | U | 1/2017 | |
| CN | 106457055 | A | 2/2017 | |
| GB | 2342813 | A | 4/2000 | |
| KR | 2016-0048329 | A | 5/2016 | |
| WO | 2007137577 | A1 | 12/2007 | |
| WO | 2009047225 | A1 | 4/2009 | |
| WO | 2010023070 | A1 | 3/2010 | |
| WO | 2015173246 | A1 | 11/2015 | |
| WO | 2016037978 | A1 | 3/2016 | |
| WO | WO-2016037978 | A1 * | 3/2016 | G06F 3/04845 |

OTHER PUBLICATIONS

Chinese Office Action and Search Report issued in corresponding Chinese application No. 201880026362.4, dated Dec. 14, 2020. (Translation) (13 pages).

International Search Report issued in international application No. PCT/EP2018/055023, dated Sep. 17, 2018.

Written Opinion of the International Search Authority, issued in international application No. PCT/EP2018/055023, dated Sep. 17, 2018.

International Preliminary Report on Patentability issued in international application No. PCT/EP2018/055023, including a Response to the International Search Report and the Written Opinion with amended claims, dated Jun. 5, 2019.

* cited by examiner

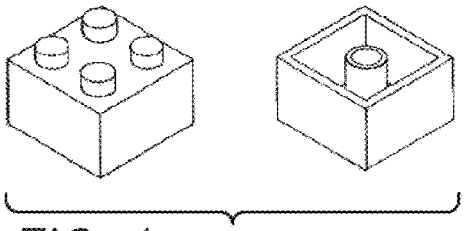
FIG. 1 - PRIOR ART
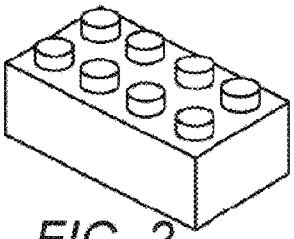
FIG. 2
PRIOR ART
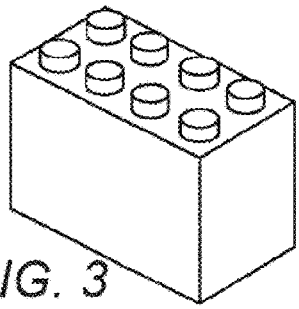
FIG. 3
PRIOR ART
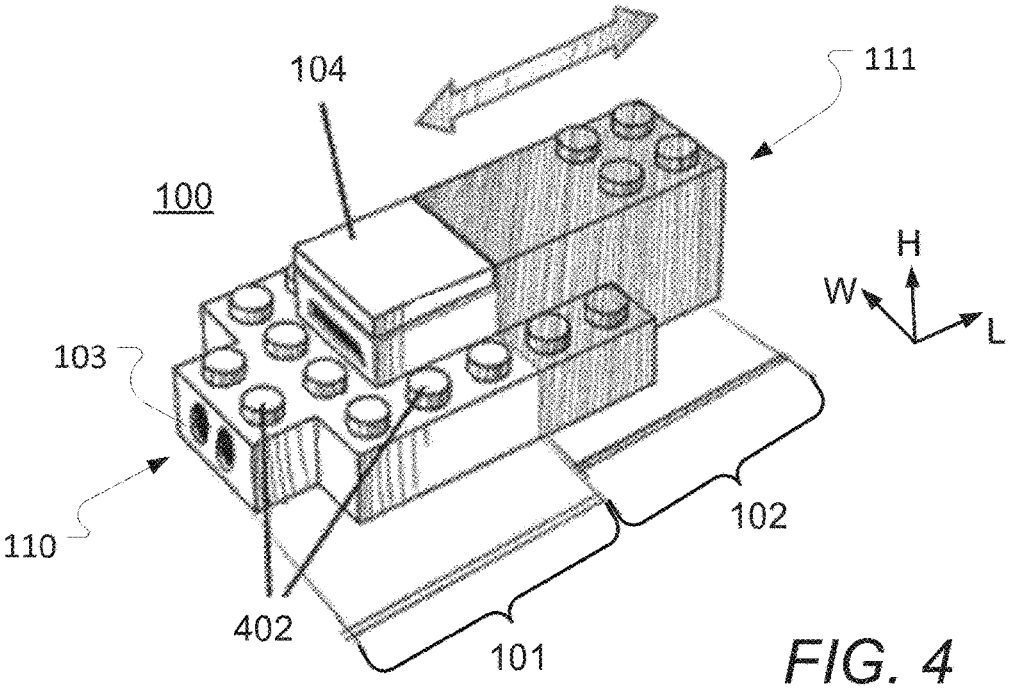
FIG. 4
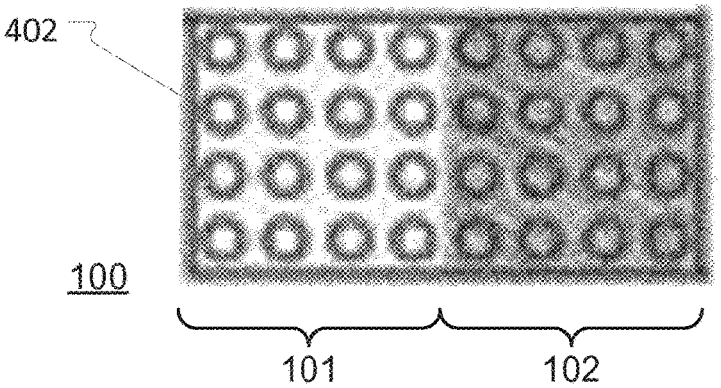
FIG. 15

INTERACTIVE MODULAR CONSTRUCTION ELEMENT AND A MODULAR CONSTRUCTION SYSTEM WITH INTERACTIVE MODULAR CONSTRUCTION ELEMENTS

CROSS-REFERENCE TO RELATED APPLICATIONS

This application is a U.S. National Stage of International Application No. PCT/EP2018/055023, filed on 1 Mar. 2018 and published on 7 Sep. 2018, as WO 2018/158357 A2, which claims the benefit of priority to Danish Patent Application No. DK PA201770155, filed on 3 Mar. 2017. The content of each of the above referenced patent applications is incorporated herein by reference in its entirety for any purpose whatsoever.

FIELD OF THE INVENTION

The invention relates to one or more interactive modular construction elements and modular construction systems comprising one or more of such elements, where the elements and systems may be toy, educational, etc. modular construction elements and systems, respectively.

BACKGROUND

Toy construction systems have been known for decades. Over the years, simple box-shaped building blocks have been supplemented with dedicated construction elements with either a specific appearance or a mechanical or electrical function to enhance the play value. Such functions include e.g. motors, switches, and lamps, but also programmable processors that accept input from sensors and can activate function elements in response to received sensor inputs.

Self-contained function construction elements exist which have a function device adapted to perform a preconfigured function, an energy source for providing energy to the function device for performing the function, and a trigger responsive to an external trigger event to trigger the function device to perform the function. Typically, such known function construction elements are designed for manual activation of a mechanical trigger and only provide a limited play value.

WO2007/137577 discloses a toy construction system comprising function elements and control elements. The function and control elements are electrically interconnectable via a system of wires and plugs, such that the function elements receive both electrical power and control signals from the control elements. Even though this system avoids the need for an electrical power source in the function elements, it requires a certain level of abstract thinking and technical insight in order to correctly interconnect the construction elements so as to construct functional toy models from such a system. In particular, an understanding of how a control structure constructed from such a construction system works requires basic knowledge about electricity and that electrical signals may be used to control functions. Moreover, this prior art system requires electrical connections, e.g. in the form of wires, between the elements, thus limiting the freedom to freely construct toy construction elements.

U.S. Pat. No. 8,354,918 discloses a method to elicit a behaviour in response to a simplex communication signal. In this prior art method, a receiver device receives an encoded simplex communication signal including an identifier from a transmitter device. The method further comprises referencing a stored program in the receiver device to a stored program block corresponding to the identifier. The receiver device then initiates execution of the program block and renders a behaviour in accordance with or corresponding to the program block corresponding to the simplex communication signal. The receiver device includes a program database, wherein the receiver is programmed to reference a stored program block of the program database corresponding to the identifier. The receiver device also includes mechanisms to enable a behaviour in accordance with the program block to be audibly and visibly perceived.

GB 2342813 discloses an educational toy system that comprises a transmitting and receiving toy wherein the transmitting toy is capable of remotely controlling the receiving toy. The transmitting toy comprises a monitoring device which monitors for status changes such as detection of vibration, orientation, ultrasonic or infrared signals and, in response, sends output signals containing identification and status-dependent action data. The identification data identifies the receiving toy to be affected whilst the action data tells the toy what action to perform (e.g. production of movement, sound, or light). The receiving toy compares the identification data with one or more stored id's and if it has a predefined relationship with one of the id's, performs the action corresponding to the action data. At least one of the identification data transmitted by the transmitting toy and the stored id's of the receiving toy may be programmed by the user. The receiving toy can be put into a programming mode wherein it listens for the identification data of a nearby transmitting toy and stores that data in its list of stored id's.

WO 2010/23070 discloses a toy construction system comprising construction elements with coupling members for releasably interconnecting construction elements, the toy construction system comprising function construction elements with such coupling members and each having a function device adapted to perform a controllable function and an energy source for providing energy to the function device for performing the controllable function, each function construction element comprising a light sensor for receiving visible light encoding a control signal; and a control circuit connected to the light sensor and to the function device and adapted to decode the received control signal and to control the controllable function responsive to the decoded control signal.

It is generally desirable to provide one or more interactive modular construction elements, such as an interactive toy and/or educational modular construction element, that are suitable for use in a modular construction system and that will enhance the educational and play value of the construction element(s) and/or system. Even though the above prior art systems provide for a wired or wireless control of functions, it remains desirable to provide one or more interactive modular construction elements and/or a system wherein a set of interactive modular construction elements easily may be used in different construction models and interchangeably with other modular construction elements. Moreover it is desirable to provide an interactive modular construction system that allows users, in particular children, to construct multiple interactive modular construction element models in a user-friendly, efficient, yet flexible and reliable manner without the need for a detailed knowledge of control structures, data communication, and how to connect electrical wires, conductors, etc. properly.

SUMMARY

Disclosed herein are aspects of an interactive modular construction element for a modular construction system.

According to a first aspect, the interactive modular construction element comprises a sensor being responsive to a predetermined sensor input and adapted to output a sensor signal corresponding to or representing the predetermined sensor input. Additionally, the interactive modular construction element comprises a function element adapted to perform at least one controllable function in response to a control signal. Furthermore, the interactive modular construction element comprises a control circuit connected to the sensor to receive the sensor signal and connected to the function element to provide the control signal. The control circuit is adapted to provide the control signal in response to the sensor signal thereby controlling the function element in response to the sensor signal. Moreover, the interactive modular construction element comprises an input part and an output part, where the input part and the output part are different from each other. By part is to be understood a coherent portion (or coherent part) of the interactive modular construction element. That the input part and the output part are different from each other means that they form different distinct (to a user) parts of the interactive modular construction element.

Hence a self-contained interactive modular construction element with integrated and connected input and output is provided. This enables one or more functions to be carried out based on input from one or more sensors, which increases the play value. This is furthermore provided without a need for connecting and/or aligning electrical conductors, wires, etc. across or between individual construction elements for connecting the sensor(s) to the function element(s), which otherwise would limit the freedom to freely construct modular constructing system models. Additionally, no technical insight or basic knowledge about electricity is needed in order to correctly interconnect respective construction elements. Hence, the added functionality is provided in an intuitive and accessible way for users of virtually all ages and all skill levels.

The interactive modular construction element, or rather the control circuit, may be pre-programmed to exhibit all kinds of behaviour by selecting what function(s) should be carried out in response to what sensor input(s) and how. Consequently, the function elements may be controlled to exhibit a relatively complex behaviour without requiring the user to have advanced technical or programming skills. In some embodiments, the control circuit may, alternatively or in addition, be user-programmable.

Additionally, the sensor(s) and function element(s) are operable without moving parts between them and do not require the establishment of electrical contact between them, thereby further providing a mechanically robust system that is suitable also for small children.

Additionally, a simple way to add functionality to a modular construction system or model is provided. One or more interactive modular construction elements are simply added or used in the system or model.

That the sensor(s) and function element(s) are in a self-contained interactive modular construction element also provides for an intuitive use, also for small children, as it is easy and intuitive to make the connection between and understand the sensor(s) and the function element(s) and their functional relationship.

That the input part and the output part are different distinct parts of the interactive modular construction element provides an expedient and intuitive way of determining what part relates to input and what part relates to output of an interactive modular construction element. This enables users, even young users, such as small children, to readily use the interactive modular construction element with little or virtually no learning curve.

A sensor may be any suitable device being responsive to a predetermined sensor input, in principle any physical parameter or characteristic, and generating a sensor signal corresponding to, representing, and/or reflecting the predetermined sensor input. One example of a sensor is a sound registering sensor for detecting presence of sound. The sensor may e.g. be simple, e.g. simply registering whether a sound is registered being above a predetermined sound level or threshold, or more advanced, e.g. measuring a sound level of the registered sound.

In some embodiments, the sensor is a movement sensor, e.g. a 6 axes movement sensor such as accelerometer and gyroscope. Alternatively, the movement sensor is a simpler 3 axes movement sensor.

Other examples of sensors may be responsive to other inputs such as mechanical forces, push, pull, rotation, tilt, human manipulation, touch, electrical signals, radio frequency signals, optical signals, visible light signals, infrared signals, magnetic signals, temperature, humidity, radiation, etc. The sensor may be configured to provide a binary signal, e.g. indicative of the presence or absence of an input. Alternatively or additionally, the sensor may be configured to generate a multi-level or even continuous signal indicative of multiple different inputs and/or indicative of a level or magnitude of activation. Accordingly, the generated sensor signal may be indicative of a property of the received sensor input, e.g. a direction of a rotation or tilt, or a degree of the detected quantity, e.g. the speed of a rotation or motion, a force, a temperature, a sound pressure, a light intensity, a tilt angle, etc.

A function element may be any suitable device for performing a function, such as a function that provides a user-perceptible effect, such as a visible and/or audible effect.

Other examples of function elements may include any suitable mechanical and/or electrical device, arrangement, and/or circuitry adapted to perform one or more mechanical and/or electrical functions.

Examples of a mechanical function that the function elements described herein can perform include driving a rotating output shaft, winding-up a string or a chain which enables pulling an object closer to a construction element, moving a hinged part of the function element which enables e.g. opening or closing a door, ejecting an object, rotating a turntable, moving a linear actuator, etc. Such mechanical motions can be driven by an electric motor powered by a battery, etc. of the construction element or another suitable power source.

Examples of an electrical function that the function elements described herein can perform include operating a switch with accessible terminals, emitting constant or blinking light, activating several lamps in a predetermined sequence, emitting audible sound such as beep, alarm, bell, siren, voice message, music, synthetic sound, natural or imitated sound simulating and/or stimulating play activities, recording and/or playback of a sound, emitting inaudible sound such as ultrasound, emitting a radio frequency signal or an infrared signal to be received by another component, providing visible output via a display, etc.

Hence, examples of function elements include a light source such as a lamp or LED, a sound generator, a motor, a hinged part, a rotatable shaft, a signal generator, a linear actuator, a display, or the like.

A function element (or the interactive modular construction element) may also comprise a suitable memory and/or storage to store relevant information and/or parameters.

In some embodiments, the interactive modular construction element is divided across a predetermined first direction into the input part and the output part. This provides a clear distinction between the input part and the output part. The predetermined first direction may e.g. be a direction that is substantially parallel, e.g. parallel, to a general length (e.g. longest length) of the interactive modular construction element. Alternatively, the predetermined first direction may also be another predetermined direction. A clear distinct division of the input and the output part of the interactive modular construction element further enhances the expedient and intuitive way of determining what part is the input part and what part is the output part of the interactive modular construction element. That the interactive modular construction element is divided does not necessarily mean that the interactive modular construction element is separated into the input part and the output part (although that could be the case in some embodiments) but rather that the input part and the output part forms different distinct parts of the interactive modular construction element.

In some embodiments, the sensor is located, fully or at least partly, in the input part and/or the function element is located, fully or at least partly, in the output part. In this way, an intuitive way of tying the sensor to the input part and/or the function element to the output part is provided even for young users, such as children.

In some embodiments, it is only at least a respective visible part of the sensor and/or the function element that is respectively located in the input and/or output part. It is not significant or at least less significant where respective parts (that are not visible to a user) of the sensor and/or the function element is located internally of the interactive modular construction element.

It is noted, that located in the input and/or output part encompasses, at least in some embodiments, located at or located on, respectively, the input and/or output part in relation to the location of the sensor and/or function element.

In some embodiments, the sensor is located at or towards a first end of the construction element and the function element is located at or towards a second end of the construction element, the second end being generally opposite the first end. Or put in another way, the input part is located at or towards the first end and/or the function element is located at or towards the second end. This emphasizes the distinction between the sensor and the function element (and between the input and the output part).

In some embodiments, the input part takes up, forms, etc. a first predetermined portion or extent of the interactive modular construction element in a first predetermined direction (e.g. along a general length (e.g. longest length) of the construction element or alternatively another predetermined direction) and the output part takes up, forms, etc. a second predetermined portion or extent at an opposite end of the interactive modular construction element in the first direction. In some embodiments, both the first and the second predetermined portion or extent is each substantially 50%, e.g. 50%, of the interactive modular construction element in the first predetermined direction, i.e. the input part and the output part each constitutes 50% or about 50% respectively of a housing, outer part, etc. of the interactive modular construction element.

In some embodiments, the input part comprises one or more user input and/or operation elements, e.g. located on a top of the input part. If the one or more user input and/or operation elements is/are located on the top, it allows easy access to them, even when the interactive modular construction element is used in a model comprising a plurality modular construction elements. Alternatively, the one or more user input and/or operation elements, or at least one or some of them, may be placed elsewhere on the interactive modular construction element.

In some embodiments, the input part has a first colour and the output part has a second colour, where the first colour is distinctly different (for a user) to the second colour. This further distinguishes the input part and the output part from each other to a user by making them visually distinct. In some further embodiments, the first colour is white or alternatively a light colour while the second colour is relatively darker.

In some embodiments, the input part comprises a first number of coupling members located at a first level and/or the output part comprises a second number of coupling members located at a second level where the first number and/or the second number of coupling members is at least five or at least six. In some embodiments, the first level and the second level is at a same level. Having such a minimum number of coupling members at a same level (same level for at least a respective input or output part) increases the possibilities and diversity of using the interactive modular construction element as part of a modular constructing system to build various models and increases the buildability usage of the interactive modular construction element. Additionally, it further increases the structural stability and/or integrity of such models. The first and second number may be the same or different and/or the first and second level may be the same or different. The coupling members may e.g. be studs or alternatively other types of suitable coupling members. In some embodiments, at least two of the coupling members are located at a same level at a respective part (input and/or output). In some embodiments, the input part and/or the output part (of an interactive modular construction element) comprises a number of further coupling members at a respective further level.

In some embodiments, the interactive modular construction element further comprises a wireless communications receiver, e.g. a wireless communications transceiver, connected to the control circuit where the control circuit is further adapted to modify, change, and/or provide the control signal in response to one or more external control signals received via the wireless communications receiver (or transceiver). This allows for remote control (or at least remote influence of control) of the function element of the interactive modular construction element by one or more external devices that may be one or more other interactive modular construction elements as disclosed herein and/or one or more electronic devices. Accordingly, a functional element (the output part) of the interactive modular construction element may be controllable responsive to a sensor (the input part) of one or more other interactive modular construction elements and/or one or more electronic devices. Such an interactive modular construction element may be referred to as a receiving element (when receiving a signal).

A received external control signal may e.g. be a sensor signal and/or a control signal, or modifications thereof, received from another interactive modular construction element and/or from the one or more external devices.

In some embodiments, the interactive modular construction element further comprises a wireless communications transmitter, e.g. a wireless communications transceiver, connected to the control circuit where the control circuit is further adapted to supply the sensor signal and/or the control signal as an external control signal to one or more interactive modular construction element as disclosed herein and/or one or more electronic devices. Such an interactive modular construction element may be referred to as a transmitting element (when supplying a signal). This allows the interactive modular construction element to remotely control (or at least remotely influence control of) a function element of another interactive modular construction element and/or one or more electric devices. Accordingly, a sensor (the input part) of the interactive modular construction element may control a functional element (the output part) of one or more other interactive modular construction elements, respectively, and/or one or more electronic devices.

For example, multiple interactive modular construction elements may detect each other's presence (e.g. by a suitable discovery procedure of a short range communications protocol such as Bluetooth, Bluetooth Low Energy (BLE), or similar). The transmitting element may then send the sensor or control signal to selected ones of the detected other interactive modular construction elements or broadcast the signals to all detected interactive modular construction elements. In some embodiments, the transmission may be performed without prior detection of other elements. For example, the transmitting element may broadcast its sensor/control signal. The broadcast message may include an identifier of the transmitting element and/or one or more identifiers of target receiving elements and/or further information allowing a receiving element to selectively react to a message. Other elements may thus listen to broadcast signals and react to all signals (i.e. control its function element responsive to the received signal) or they may selectively react only to some signals, e.g. only signals from certain elements, or only to signals addressed to them, etc.

Each interactive modular construction element may accordingly have stored control code/program code which associates respective output behaviours to different control signals (where the different control signals may be received from the interactive modular construction element's own input part and/or from another interactive modular construction element).

Interactive modular construction elements may also associate respective behaviour(s) to respective combinations of control signals e.g. a combination of a control signal from the interactive modular construction element's own input part and the input part of one or more other interactive modular construction elements (e.g. when these are received simultaneously or otherwise within a time window or other timely correlation). Consequently, a function element may be controlled to exhibit a relatively complex behaviour (i.e. behaviour based on its own input part/sensor and one or more remote interactive modular construction elements) in a simple way and without requiring a user to have advanced technical or programming skills.

The interactive modular construction elements may be manufactured with a default behaviour (default program(s)) and/or the behaviour (program (s)) may be modified (receiving modified program(s) from a computer or other external device).

An external device may e.g. be a desktop computer, a tablet computer, a smartphone, a laptop computer, or another programmable computing device.

Hence, the wireless communications receiver, the wireless communications transmitter, and/or the wireless communications transceiver of an interactive modular construction element may be a part of a wireless communications interface for communicating with one or more other interactive modular construction elements of a modular construction system and/or one or more external devices.

Generally, the wireless communications interface (including respective wireless receivers, transmitters, and/or transceivers) of the interactive modular construction elements may implement any suitable wireless communications technology, e.g. using radio-frequency communication following a suitable communications protocol. In some embodiments, the wireless communications technology is a short-range technology. The communications range of the wireless communication may be at least 0.5 m, e.g. at least 1 m. In most situations, a communications range of less than 10 m and, in most cases even less than 5 m is sufficient, even though in some embodiments longer ranges may be acceptable or even desirable. The control signal may be encoded into a wireless signal in any suitable way, e.g. by an amplitude modulation, a frequency modulation, and/or a more complex modulation technique.

In some embodiments,

- the input part comprises one or more (first) visual indicators and/or has a shape adapted to communicate visually to a user what type of sensor is comprised by the interactive modular construction element, and/or
- the output part comprises one or more (second) visual indicators and/or has a shape adapted to communicate visually to a user what type of function is carried out by the function element of the interactive modular construction element.

In this way, it is easy and intuitive to understand, even for young users such as children, the respective purpose and function of the sensor and/or function element.

The visual indicators of the input part may e.g. be visible microphone grids when the sensor is a sound registering sensor, at least partly visible diodes, light sensing elements, or similar for when the sensor is a light registering sensor.

The visual indicators of the output part may e.g. be speaker grills for when the function element is a sound generator, speaker, etc.

In some embodiments, the sensor and the function element are selected from the group consisting of:

- a motion or movement sensor, tilt sensor, or the like as a sensor and a speaker (e.g. amplified), buzzer, sound generator, or the like as a function element,
- a proximity sensor or the like as a sensor and a motor or the like as a function element,
- a tacho sensor or the like as a sensor and a motor or the like as a function element,
- a sound registration sensor, sound level sensor, or the like as a sensor and a display element or the like as a function element, and
- a sound registration sensor, sound level sensor, or the like as a sensor and a motor or the like as a function element.

In some embodiments, the interactive modular construction element comprises two or more sensors and/or two or more function elements (the number of sensors need not be equal to the number of function elements but can be). At least in some further embodiments, all sensors (or at least their visual indicators if having such) are located in the input part and all function elements (or at least their visible functional part, i.e. the part that is visibly responsible for carrying out a respective function) are located at the output part of the interactive modular construction element. The control circuit may then be adapted to receive a plurality of sensor signals (e.g. one from each sensor) and/or provide a plurality of control signals (e.g. one for each function element) thereby controlling the function element(s) in response to the sensor signal(s).

In some embodiments, the interactive modular construction element is formed having at least two substantially planar layers (with coupling members). This provides an interactive modular construction element with increased buildability usage as the structural stability and/or integrity of models using such an interactive modular construction element may be increased.

In some embodiments, the function element or the construction element comprises a suitable memory and/or storage to store relevant information, data (e.g. user-created content), and/or parameters. Such memory and/or storage may e.g. store one or more sound files (as selected or made by a user and then downloaded to the construction element) e.g. to be played in response to one or more sensor signals if the function element is a sound generator or similar. As an example, one single sound file may be play upon sensor activation. As another example, a plurality of different sound files is stored and a particular one of those is played in dependence on what particular sensor signal is provided by the sensor(s), e.g. play this sound if the sensed tilt motion is this, play another sound if the sensed tilt motion is that, play this sound if a sensed sound is above this level, etc. The memory and/or storage may e.g. also store behaviour, rules, programs, etc. (e.g. pre-set and/or user-modifiable) governing what function should be carried out in response to what sensor signal and how; especially in a system of a plurality of construction elements.

According to a second aspect, disclosed herein are embodiments of a modular construction system comprising a plurality of modular construction elements wherein at least one of the plurality of modular construction elements is an interactive modular construction element as disclosed herein in relation to the first aspect. This enables one or more functions to be carried out based on input from one or more sensors, which increases the play value, in a modular construction system, even if only comprising one interactive modular construction element.

In some embodiments, the plurality of modular construction elements comprise a plurality of interactive modular construction elements as disclosed herein in relation to the first aspect. In some further embodiments, respective input parts of two or more of the plurality of interactive modular construction elements are of different type from each other and/or respective output parts of the two or more of the plurality of interactive modular construction elements are of different type from each other. By being of different type in this context of a system is to be understood that interactive modular construction elements are responsive to different sensor signals (e.g. having different sensors), are providing different control signals for the same sensor signals, etc., and/or are performing different functions (e.g. having different function elements), etc. Having a plurality of interactive modular construction elements provides even further functions and input options increasing the play value further, especially but not only if the interactive modular construction elements are arranged to communicate together and mix sensor input and/or function output across the interactive modular construction elements as disclosed herein.

In some embodiments, the output parts of the plurality of interactive modular construction elements have a distinctly different colour and/or the input parts of the plurality of interactive modular construction elements have the same colour. In this way, it is readily apparent to users, such as children, what the input part is and what the output part is.

In some further embodiments, the output parts of the plurality of interactive modular construction elements have a colour selected from a plurality of predetermined distinct colours where output parts having designated similar or corresponding functions have a same colour.

According to a third aspect, disclosed herein are embodiments of a modular construction system comprising two or more interactive modular construction elements wherein at least two interactive construction elements each comprises an input part being responsive to a predetermined sensor input and an output part being adapted to perform at least one controllable function. Output of the output part of a first one of the at least two interactive construction elements is configured to be controllable responsive to an input received by the input part of the first interactive construction element and the output of the output part of the first interactive construction element is controllable responsive to an input received by the input part of a second one of the two or more interactive construction elements. In other words, an output of the output part of a particular interactive construction element is controllable responsive to input of its own input part and to input of an input part of another interactive construction element. The at least two interactive construction elements may each e.g. comprise a wireless communications receiver and/or transmitter, e.g. a wireless communications transceiver (e.g. as disclosed herein) to transfer the relevant information to the first interactive construction element from the second interactive construction element.

One or more, e.g. at least two, of the interactive modular construction elements according to the third aspect may be elements as disclosed in connection with the first aspect or other types of interactive modular construction elements then each e.g. comprising a sensor being responsive to the predetermined sensor input and adapted to output a sensor signal corresponding to or representing the predetermined sensor input (i.e. representing the input of the input part); a function element adapted to perform the at least one controllable function (i.e. perform the output of the output part) in response to a control signal; and a control circuit being connected to the sensor and to the function element to provide the control signal, wherein the control circuit is adapted to provide the control signal in response to the sensor signal from the sensor and to provide the control signal in response to a sensor signal from a sensor of another interactive construction element thereby controlling the function element (i.e. controlling the output of the output part) in response to a sensor signal from its own sensor and a sensor of another (second) interactive construction element. Even though the output is controllable in response to both its own sensor and an external sensor it may at different time instances actually be controlled in response to only its own sensor signal, in response to at least one other sensor of at least one other interactive construction element, or a combination or mix thereof.

Accordingly is provided a modular construction system comprising a two or more interactive modular construction elements capable of communicating wirelessly and adapted to be able to mix sensor input and/or function output across the interactive modular construction elements.

In some embodiments, the two or more interactive modular construction elements are responsive to different sensor signals (e.g. having different sensors), are performing different functions (e.g. having different function elements), are providing different control signals for the same sensor signals, etc. e.g. with some overlap.

The embodiments of the first and second aspects as disclosed herein are also embodiments of the modular construction system according to the third aspect where applicable.

The term 'modular construction element' and 'modular construction system' (i.e. a system comprising a modular construction element) are to be construed as comprising a modular construction element/system used as toys, for educational purposes, or similar.

BRIEF DESCRIPTION OF THE DRAWINGS

FIGS. 1-3 each show a prior art modular toy construction element,

FIG. 4 schematically illustrates a perspective view of an embodiment of an interactive modular construction element for a modular construction system as disclosed herein;

FIG. 15 schematically illustrates a top view of a maximum size of an interactive modular construction element as disclosed herein according to some embodiments;

DETAILED DESCRIPTION

Figure 5:
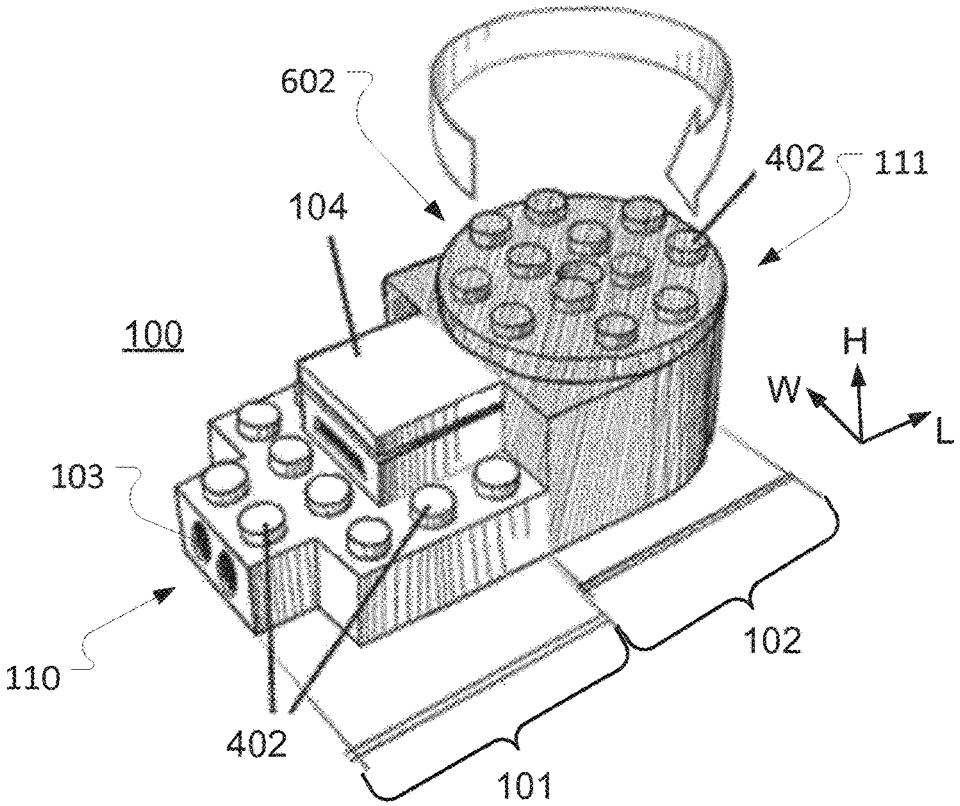
FIG. 5 schematically illustrates a perspective view of an alternative embodiment of an interactive modular construction element as disclosed herein.

Various aspects and embodiments of an interactive modular construction element and of a modular construction system, comprising at least one such an interactive modular construction element, as disclosed herein, will now be described with reference to modular construction elements in the form of bricks. However, the invention may be applied to other forms of construction elements for use in, e.g. toy, educational, and/or the like, construction sets.

In FIG. 1 is shown a toy construction element with coupling studs on its top surface and a cavity extending into the brick from the bottom. The cavity has a central tube, and coupling studs on another brick can be received in the cavity in a frictional engagement as disclosed in U.S. Pat. No. 3,005,282. FIGS. 2 and 3 show other such prior art construction elements. The construction elements shown in the remaining figures have this known type of coupling members in the form of cooperating studs and cavities. However, other types of coupling members may also be used in addition to or instead of the studs and cavities. The coupling studs are arranged in a square planar grid, i.e. defining orthogonal directions along which sequences of coupling studs are arranged. The distance between neighbouring coupling studs is uniform and equal in both directions. This or similar arrangements of coupling members at coupling locations defining a regular planar grid allow the toy construction elements to be interconnected in a discrete number of positions and orientations relative to each other, in particular at right angles with respect to each other.

In the following, examples of interactive modular construction elements will be described as well as their operation and potential interaction with each other.

FIG. 4 schematically illustrates a perspective view of an embodiment of an interactive modular construction element for a modular construction system as disclosed herein.

Shown is an example of an interactive modular construction element 100 (forth equally also referred to simply as construction element).

The construction element 100 is, in this particular and corresponding embodiments, generally shaped as an orthogonal polyhedron with flat side faces and having coupling members 402 extending from its upper surface and cavities extending into its bottom surfaces (not explicitly shown; see e.g. FIG. 1). However other shapes and sizes of construction elements may be used. The coupling members 402 are arranged in planar, regular, and parallel grids defining the coupling locations. The coupling members 402 may e.g. be stubs or the like or alternatively another type of suitable coupling members.

Indicated in FIG. 4 are the directions of L(ength), H(eight), and W(idth) (width may also be referred to as depth) for easy reference relating to the relevant Figures not necessarily to the construction element 100. Other labels, definitions, notations, etc. may be used instead.

According to an aspect the present invention, the construction element 100 comprises two distinct parts, namely an input part 101 and an output part 102, where the input part 101 and the output part 102 are different from each other. In some embodiments, the construction element 100 is divided across a predetermined first direction, e.g. a (as shown) predetermined first direction that is parallel to the general length L of the construction element 100, into the input part 101 and the output part 102.

In some embodiments (and as shown), the input and output parts 101, 102 are of equal size or extent along the predetermined first direction, i.e. they each form 50% or substantially 50% of the construction element 100 along the predetermined first direction. It is noted that for these embodiments, the input and output parts 101, 102 need not be of equal size or extent along other predetermined directions, such as the height H and/or the width W of the construction element 100; at least not everywhere. However, in some embodiments (like shown in FIG. 4), a portion of the input part 101 and a portion of the output part 102 that both have a greatest extent along a given direction (height and/or width) are equal; or put in another way, the highest part of the input part 101 is equal in height to the highest part of the output part 102 (e.g. excluding coupling members and/or other elements) and the widest part of the input part 101 is equal in width to the widest part of the output part 102. See e.g. also FIG. 15 and related description. This does not necessarily signify that the input and/or output part 101, 102 cannot be of less height and/or width, respectively, at other parts, as e.g. is also illustrated in FIG. 4.

According to aspects of the present invention, the construction element 100 comprises one or more sensors (not shown; see e.g. 601 in FIG. 6) and one or more function elements (not shown; see e.g. 602 in FIGS. 5 and 6), i.e. the sensor(s) and the function element(s) are both a part of a single construction element 100. The sensor(s) and the function element(s) may e.g. be at least in part an integral part of the single construction element 100.

In some embodiments, the one or more sensors is/are located in the input part 101. In some further embodiments, the one or more sensors is/are located at or towards a first end 110 of the construction element 100 generally in the predetermined first direction (e.g. L). In some embodiments (e.g. same or different embodiments than the ones previously mentioned), the one or more function elements is/are located in the output part 102. In some further embodiments, the one or more function elements is/are located at or towards a second end 111 of the construction element 100, the second end 111 being generally opposite the first end 110.

That the input part 101 and the output part 102 are at respective opposite ends of the construction element 100 provides an expedient and intuitive way of determining what part is the input part 101 and what part is the output part 102 of a construction element 100. Even for young users, such as children.

In some embodiments, the construction element 100 comprises one or more user input and/or operation elements 104, e.g. a button (as is shown), a lever, slider, user touch sensitive element, etc. The one or more user input and/or operation elements 104 may be located on or at the input part 101 (as it is an input element). In some embodiments, the one or more user input and/or operation elements 104 is/are located on the top of the construction element 100 (preferably on or at the input part 101).

The one or more user input and/or operation elements 104 is/are operable to provide a user interface in some embodiments the only user-interface allowing a user to control operation of the construction element 100 and, in particular, to bring the construction element 100 in different operational modes.

In some embodiments, at least one of the user input and/or operation elements 104 is in the form of a push button on the uppermost surface of the construction element 100. In some further embodiments, the push button has a push-sensitive activation surface that extends across two coupling member locations in each (length and width) direction.

Figure 6:
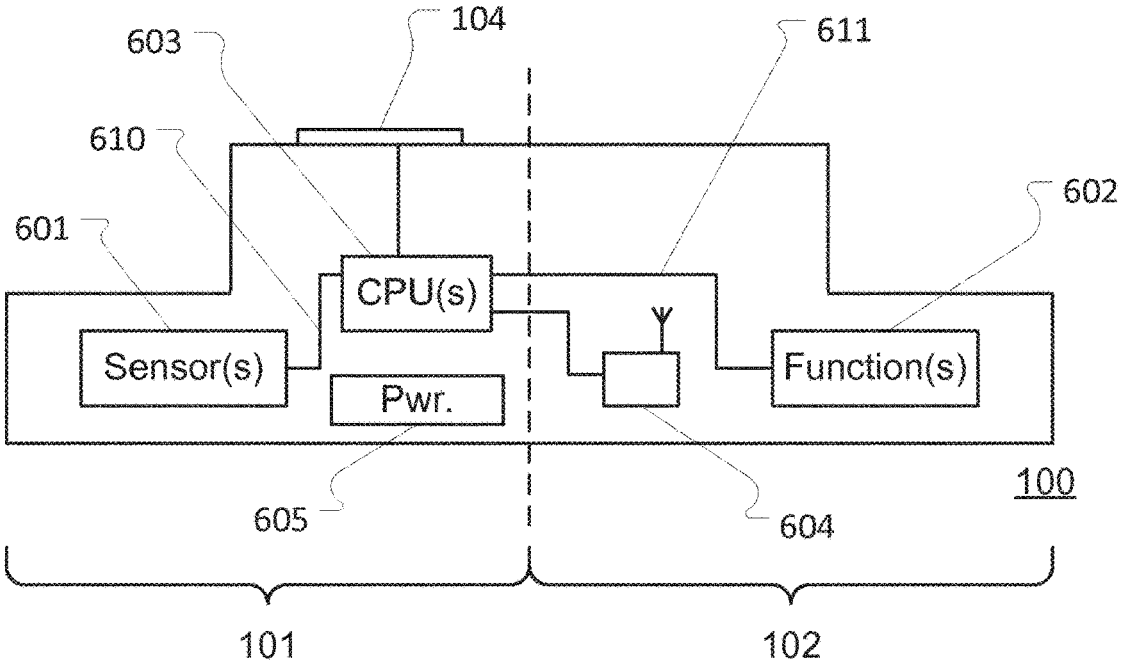
FIG. 6 illustrates a schematic block diagram of an interactive modular construction element as disclosed herein.

The construction element 100 further comprises a control circuit (see e.g. 603 in FIG. 6), e.g. comprising one or more microcontrollers, one or more microprocessors, and/or one or more other suitable processing units, or combinations thereof, operably connected to the sensor(s) (see e.g. 601 in FIG. 6) and the one or more function elements (see e.g. 602 in FIG. 6).

Figure 16:
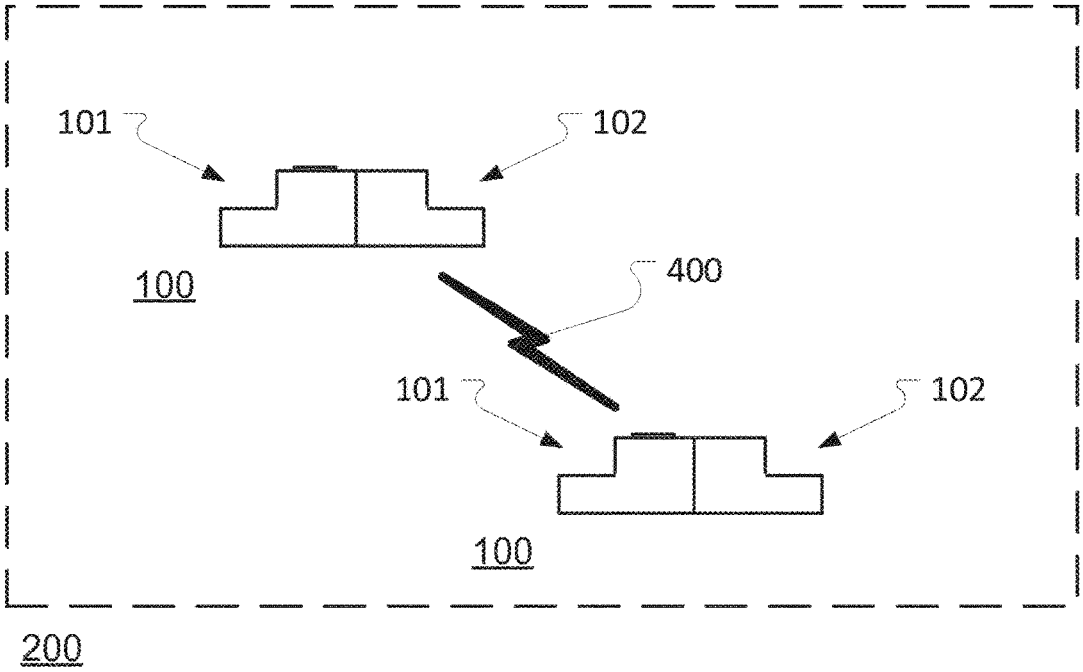
FIG. 16 schematically illustrates a modular construction system comprising a number of interactive modular construction elements as disclosed herein.
Figure 17:
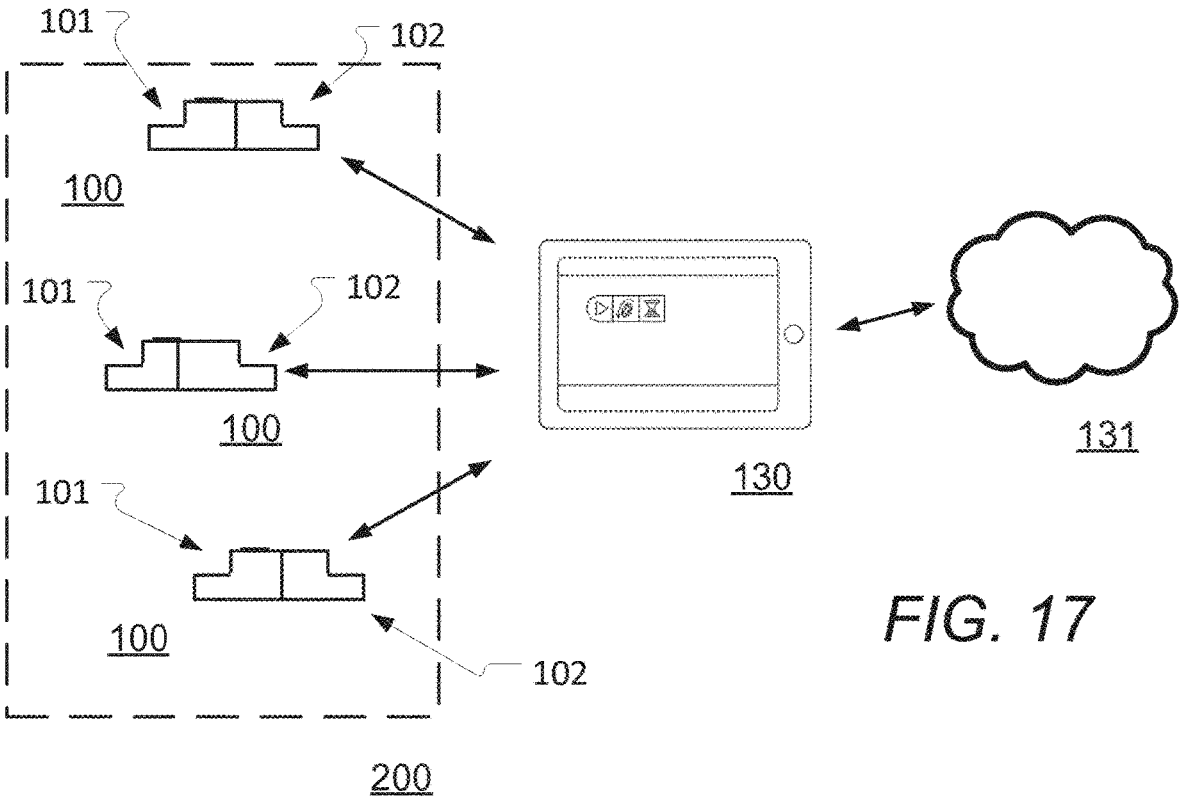
FIG. 17 schematically illustrates a data processing system or device, a communications network, and a plurality of interactive modular construction elements forming a modular construction system.

In some embodiments, the construction element 100 further comprises a wireless communications receiver and/or wireless communications transmitter, e.g. in the form of a communications transceiver, or the like (see e.g. 604 in FIG. 6) connected to the control circuit and operable for radio-frequency communication with other interactive modular construction elements 100 (e.g. as explained further in connection with FIG. 16) and/or one or more other electronic devices (e.g. as explained further in connection with FIG. 17).

The construction element 100 further comprises a battery, a rechargeable electric capacitor, or another suitable power source (see e.g. 605 in FIG. 6) for providing power as applicable to the control circuit, the sensor(s), the function element(s), and the communications transceiver (if having such).

The walls of the construction element 100 generally define a housing which accommodates the control circuit, the power source, the communications transceiver (if present), and at least in part, the sensor(s) and the function element(s).

According to an aspect of the present invention, the control circuit is configured to control the one or more function elements (of the construction element 100) responsive to one or more signals received from the one or more sensors (of the construction element 100).

The one or more sensors are, respectively or in some combination, responsive to one or more predetermined sensor inputs and adapted to output one or more sensor signals corresponding to or representing the predetermined sensor input(s).

The one or more function elements are, respectively or in some combination, adapted to perform at least one controllable function in response to one or more control signals.

The control circuit is connected to the sensor(s) to receive the sensor signal(s) and connected to the function element(s) to provide the control signal(s). The control circuit is further adapted to provide the control signal(s) in response to the sensor signal(s) thereby controlling the function element(s) in response to the sensor signal(s).

For some embodiments where the construction element 100 comprises a wireless communications receiver or wireless communications transceiver, the control circuit, in addition or as an alternative, is configured to control the one or more function elements of the construction element 100 responsive to (external) signals received via the communications receiver or communications transceiver. The control circuit may e.g. be adapted to modify the control signal (for the function element(s)) in response to an external control signal received via the wireless communications receiver or wireless communications transceiver and/or the control circuit may simply provide the external control signal as a control signal to the function element(s). In this way, the function element(s) may be controlled by other construction elements (e.g. in response to their respective sensor(s)) of a modular construction system and/or of other devices (see e.g. FIGS. 16 and 17, respectively) such as a computer, tablet, and/or other processing device.

For some embodiments where the construction element 100 comprises a wireless communications transmitter or wireless communications transceiver, the control circuit, in addition or as an alternative, is configured to control the wireless communications transmitter or wireless communications transceiver e.g. to control one or more function elements of other construction elements 100 of a modular construction system and/or of other devices such as a computer, tablet and/or other processing device. In this way, the function element(s) of other construction elements of a modular construction system and/or of other devices may be controlled in response to the sensor(s) of the construction element 100.

Accordingly, the signal(s) may be provided by/to another interactive modular construction element in required proximity of the construction element 100.

The control circuit and its interaction with the sensor(s) and the function element(s), the wireless communications receiver and/or communications transmitter, etc. is shown and explained in further details in connection with FIG. 6.

A sensor may be any suitable device or element being responsive to a predetermined sensor input, in principle any physical parameter or characteristic, and generating a sensor signal corresponding to, representing, and/or reflecting the predetermined sensor input. In the example of FIG. 4, the sensor is a sound registering sensor for detecting presence of sound. The sensor may e.g. be simple, e.g. simply registering whether a sound is registered being above a predetermined sound level, or more advanced, e.g. measuring the registered sound level of the registered sound.

A function element may be any suitable device or element for performing a function, such as a function that provides a user-perceptible effect, such as a visible and/or audible effect, etc. In the example of FIG. 4, the function element performs a function as illustrated by the lengthwise double arrow.

A modular construction system may comprise several of such construction elements 100 (potentially with at least some different respective sensors and/or function elements) responsive to sensor/control signals (from integrated sensor(s) and/or other construction element(s)) and providing different functions.

The modular construction system may e.g. be used as a part of a modular toy and/or educational building or construction set comprising construction elements 100 with coupling members for releasably interconnecting construction elements, e.g. including the known bricks shown in FIGS. 1-3 or similar. A construction set may comprise a plurality of construction elements 100 or only one.

An interactive modular construction element may e.g. comprise a motion or movement sensor, tilt sensor, or the like as a sensor and a speaker (e.g. amplified), buzzer, sound generator, or the like as a function element; a proximity sensor or the like as a sensor and a motor or the like as a function element; a tacho sensor or the like as a sensor and a motor or the like as a function element; a sound registration sensor, sound level sensor, or the like as a sensor and a display element or the like as a function element; a sound registration sensor, sound level sensor, or the like as a sensor and a motor or the like as a function element; etc.

In some embodiments, at least the input part 101 comprises one or more visual indicators 103 and/or is shaped so as to communicate visually to a user what type of sensor(s) is/are embedded in or comprised by the construction element 100 and thereby what type(s) of input a particular construction element 100 is based on. One example (as shown in FIG. 4), is e.g. a number of microphone grids 103 suitable for when the sensor is a sound registering sensor. Another example, is e.g. at least partly visible diodes, light sensing elements, or similar (see e.g. 103 in FIG. 8) for when the sensor is a light registering sensor.

In some embodiments, at least the output part 102 comprises one or more visual indicators and/or is shaped so as to communicate visually to a user what type(s) of function(s) is/are carried out by the function element(s) of the construction element 100.

Preferably, the visual indicator(s) and/or shapes are so intuitive to understand that even young users, such as children, are able to quickly learn their meaning or significance.

As mentioned, the construction element 100 comprises a number of coupling members 402. Having a sufficient number of coupling members 402, preferably on both the input part 101 and the output part 102, facilitates the use of the construction element 100 in a modular construction system. In some embodiments, the input part 101 and/or the output part 102, each comprises a number of coupling members 402, e.g. studs or alternatively other types of coupling members, located at a same (height) level, where the number of coupling members 402 are at least five, or more preferably at least six, for both the input part 101 and the output part 102. The embodiment shown in FIG. 4 only has this for the input part 101 while e.g. the embodiment of FIG. 5 has it for both.

It is noted, that the (height) levels comprising this number of coupling members 402 at a respective same (height) level need not be the same for the input part 101 and the output part 102, i.e. the levels may be displaced in relation to one another. It is further noted, that the respective number of coupling members 402 at a same respective (height) level of the input part 101 and the output part 102 need not be the same.

In some embodiments, the entire input part 101, or at least a substantial part of it, has a first colour while the entire output part 102, or at least a substantial part of it, has a second colour where the first colour is distinctly different to the second colour. This provides an expedient way for users to quickly and reliably identify what part or end of a construction element 100 is the input part 101 and what part or end of the construction element 100 is the output part 102. In particular fora modular construction system comprising a plurality of interactive modular construction elements 100. This is useful for young users.

In some embodiments, the first colour is white or at least a relative light colour while in some other or further embodiments, the second colour is relatively darker than the first colour.

In some embodiments, where a plurality of construction elements 100 are to be part of a modular construction system (see e.g. FIGS. 11-14, 16 and 17), the colour of the respective input parts 101 of the plurality of construction elements 100 is the same, e.g. white, while the colour of the respective output parts 102 are the same for groups of similar functions but different for different groups. As an example, a group of different construction elements 100 all comprising a motor function (e.g. in different forms), i.e. a 'motor' group, may e.g. all have a same colour, e.g. green, while another group of different construction elements 100 all comprising a sound emitting function (e.g. in different forms), i.e. a 'sound emitter' group, may e.g. all have a same colour different from the colour of the other group, e.g. blue, and so on.

In some embodiments, the interactive modular construction element 100 is formed having at least two substantially planar layers (with coupling members). This provides an interactive modular construction element with increased buildability usage as the structural stability and/or integrity of models using such an interactive modular construction element may be increased.

FIG. 5 schematically illustrates a perspective view of an alternative embodiment of an interactive modular construction element as disclosed herein.

Shown is an interactive modular construction element 100 corresponding to the construction element and embodiments thereof as shown and explained in connection with FIG. 4 except that this alternative embodiment comprises a different function element. In FIG. 5, the function element is a motor rotatably driving a circular construction element comprising a number of coupling members 402. The circular construction element comprises a cavity for releasably receiving a shaft that then also may be rotatably driven by the motor.

FIG. 6 illustrates a schematic block diagram of an interactive modular construction element as disclosed herein.

Shown is an interactive modular construction element 100, corresponding to the ones and embodiments thereof as explained in connection with FIG. 4 and elsewhere, having an input part 101 and an output part 102 and comprising one or more sensors 601, a control circuit 603, one or more function elements 602, a power source 605, optionally one or more user input and/or operation elements 104, and optionally a wireless communications receiver and/or wireless communications transceiver (forth also referred to simply as transceiver) 604 as explained elsewhere.

The control circuit 603 may e.g. be or comprise one or more of a microcontroller, a microprocessor, and/or other suitable processing unit, operably connected to the user input and/or operation element(s) 104, the one or more sensors 601, the one or more function elements 602, and (if present) the transceiver 604.

The transceiver 604 may be operable to transmit and receive radio-frequency signals in a suitable frequency band, e.g. in one of the ISM bands used for short-range communications technology. In fact the radio-frequency communication may utilise any suitable communications technology for communicating data, such as Bluetooth, BLE, IEEE 802.15.4, IEEE 802.11, ZigBee, etc. It will be appreciated however, that other communications technologies may be used, including technologies based on light, such as infrared light, or another wireless technology.

The transceiver 604 is operable for radio-frequency communication with other interactive modular construction elements and/or other devices.

It is noted, that the transceiver 604 need not necessarily (as is schematically shown) be located in the output part 102 and might just as well be located in the input part 102. The same applies for the power source 605 and the control circuit 603. What is significant in relation to the wireless communications receiver 604 is that it is connected to the control circuit 603 and that it is located so as to be able to reliably receive and/or transmit wireless signals.

As mentioned elsewhere, the control circuit 603 controls the function element(s) 602 in response to sensor signal(s) 610 (by providing control signal(s) 611 responsive to the sensor signal(s)) received from the one or more sensor(s) and/or controls the function element(s) 602 in response to sensor signal(s) and/or control signals as received by the transceiver 604. In some embodiments, the control circuit 603 is adapted to wirelessly communicate, via the transceiver 604, sensor signal(s) 610 from the sensor(s) 601 or one or more control signals responsive to sensor signal(s) 610 from the sensor(s) 601 to at least one other interactive modular construction element and/or other devices.

A function element (or the construction element 100) may also comprise a suitable memory and/or storage to store relevant information, data, and/or parameters. Such memory and/or storage may e.g. store one or more sound files (as selected or made by a user and then downloaded to the construction element 100) e.g. to be played in response to sensor signals if one function element 602 is a sound generator or similar. As an example, one single sound file may be played upon sensor activation. As another example, a plurality of different sound files is stored and a particular one of those is played in dependence on what particular sensor signal is provided by the sensor(s), e.g. play this sound if the sensed tilt motion is this, play another sound if the sensed tilt motion is that, play this sound if a sensed sound is above this level, etc. The memory and/or storage may e.g. also store behaviour, rules, programs, etc. (e.g. pre-set and/or user-modifiable) governing what function should be carried out in response to what sensor signal and how; especially in a system of a plurality of construction elements 100.

FIGS. 7-10 schematically illustrate perspective views of respective alternative embodiments with different input and output parts of an interactive modular construction element as disclosed herein.

Figure 7:
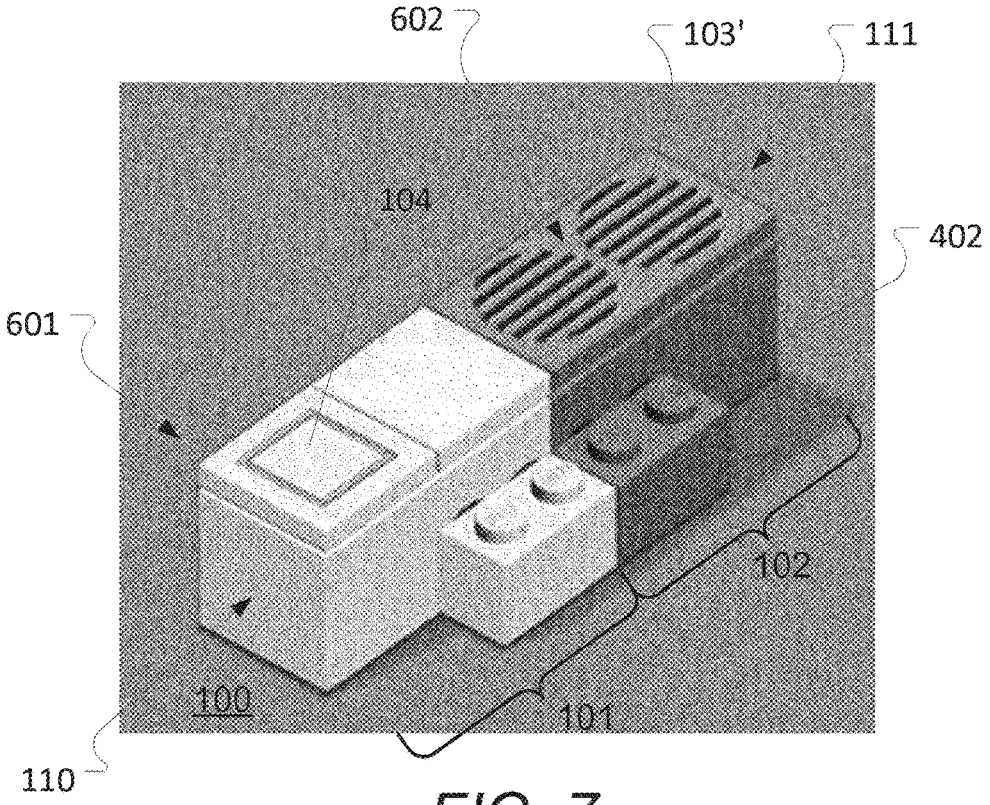
FIGS. 7-10 schematically illustrate perspective views of respective alternative embodiments with different input and/or output parts of an interactive modular construction element as disclosed herein.
Figure 12:
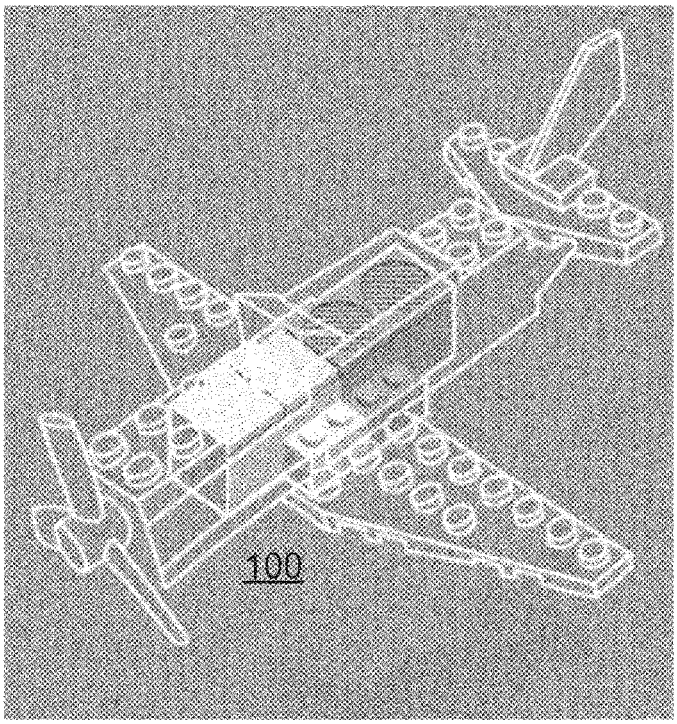

FIG. 7 schematically illustrates a perspective view of an interactive modular construction element 100 comprising a user input and/or operation element (such as a button (as is shown), lever, slider, etc.) 104, a motion or movement sensor, tilt sensor, or the like 601 at its input part 101 and a speaker (e.g. amplified), buzzer, sound generator, or the like as a function element 602 at its output part 102. This exemplary embodiment also comprises one or more visual indicators 103' here in the form of speaker grills adapted to visually communicate to a user what type of function 602 is comprised by the interactive modular construction element 100. Such an interactive modular construction element 100 may as an example e.g. be used in a model of an airplane or similar (e.g. as shown in FIG. 12) and play different airplane sounds in response to different movements of the model or of course in other types of models.

Figure 8:
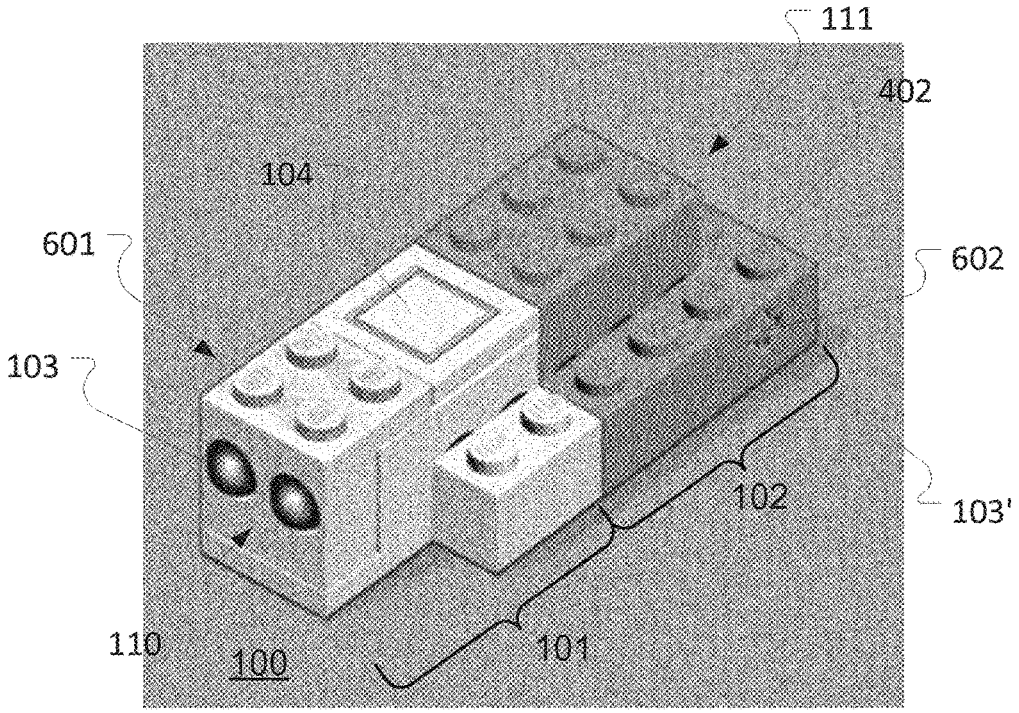

FIG. 8 schematically illustrates a perspective view of an interactive modular construction element 100 comprising a proximity sensor or the like at its input part 101 and a motor or the like as a function element at its output part 102. The construction element 100 comprises a coupling element or coupling cavity for receiving a shaft or similar that may be rotatably driven by the motor.

Such an interactive modular construction element 100 may e.g. be used in a model of a car or other vehicle, with wheels rotatably driven by the motor and e.g. reverse rotation when being within a certain distance of an obstacle or object (thereby backing away), drive forward if a certain distance to an object becomes larger than a given limit (thereby following an object, e.g. a hand), controlling the speed of the motor as a function of distance to an object, etc. It may of course also be used in other types of models.

Figure 9:
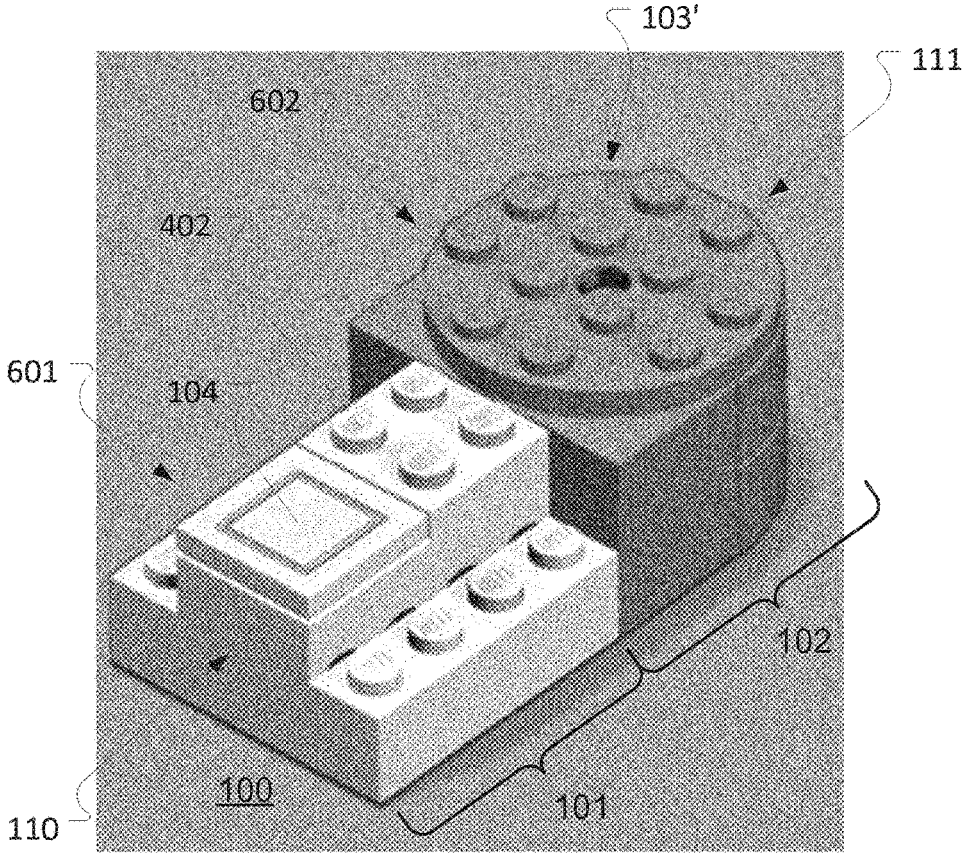

FIG. 9 schematically illustrates a perspective view of an interactive modular construction element 100 comprising a user input and/or operation element (such as a button (as is shown), lever, slider, etc.), a user touch sensitive element, or the like 104 at its input part 101 and a motor or the like as a function element at its output part 102. The construction element 100 comprises a rotatable element comprising a number of coupling members 402 where the rotatable element is rotated about a predetermined second direction, e.g. being parallel to the height direction or correspondingly of the construction element 100.

Figure 11:
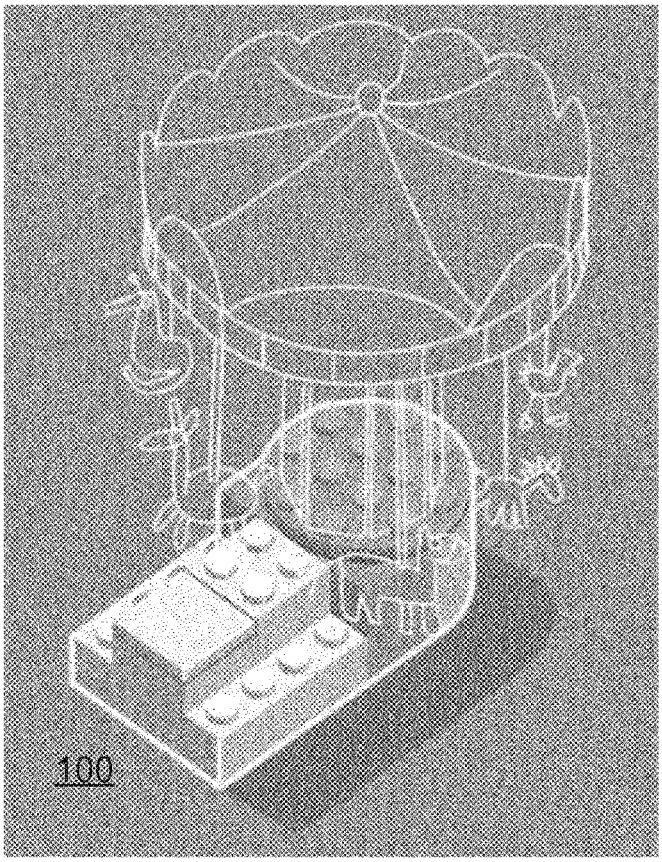
FIGS. 11-14 schematically illustrate perspective views of respective alternative embodiments of an interactive modular construction element as disclosed herein illustrated as part of a modular construction system together with additional exemplary modular construction elements forming respective modular construction models.

Such an interactive modular construction element 100 may e.g. be used in a model of a merry-go-round, see e.g. FIG. 11 (pressing the button 104 rotates a part of the merry-go-round), of a lighthouse (pressing the button 104 rotates a light construction element), a helicopter, etc. It may of course also be used in other models.

Figure 10:
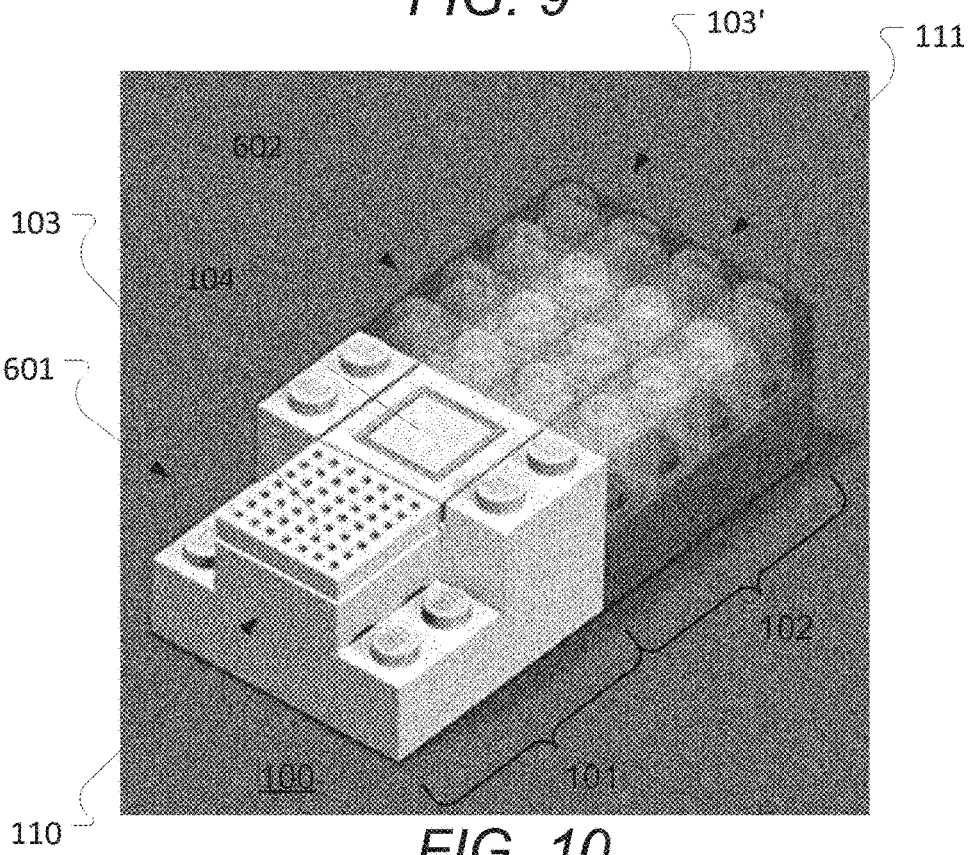

FIG. 10 schematically illustrates a perspective view of an interactive modular construction element 100 comprising a sound registration sensor, sound level sensor, or the like at its input part 101 and a display element or the like as a function element at its output part 102.

Figure 14:
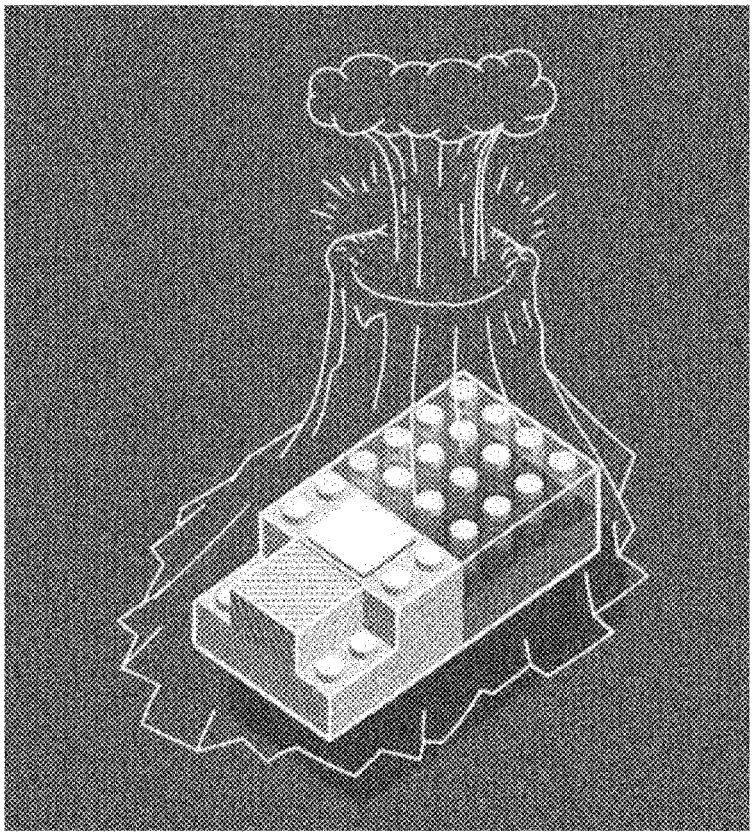

Such an interactive modular construction element 100 may e.g. be used in a model of a volcano (providing shifting red and yellow light upon sensor and/or user activation), see e.g. FIG. 14, a lighthouse (providing the lighting of the lighting house upon sensor and/or user activation), etc. It may of course also be used in other models.

FIGS. 11-14 schematically illustrate perspective views of respective alternative embodiments of an interactive modular construction element as disclosed herein illustrated as part of a modular construction system together with additional exemplary modular construction elements forming respective modular construction models.

FIG. 11 schematically illustrates a perspective view of an interactive modular construction element 100 corresponding to the interactive modular construction element 100 of FIG. 9. The interactive modular construction element 100 is shown together with additional exemplary modular construction elements as part of a modular construction system forming a modular construction model here, as an example, in the form of a merry-go-round.

FIG. 12 schematically illustrates a perspective view of an interactive modular construction element 100 corresponding to the interactive modular construction element 100 of FIG. 7. The interactive modular construction element 100 is shown together with additional exemplary modular construction elements as part of a modular construction system forming a modular construction model here, as an example, in the form of an airplane.

Figure 13:
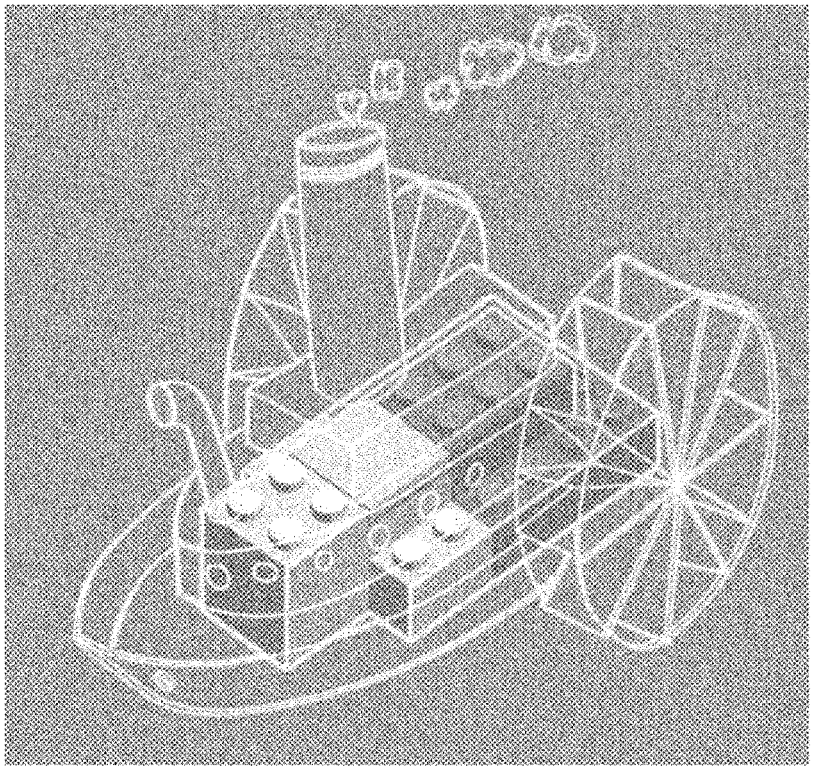

FIG. 13 schematically illustrates a perspective view of an interactive modular construction element 100 corresponding to the interactive modular construction element 100 of FIG. 8. The interactive modular construction element 100 is shown together with additional exemplary modular construction elements as part of a modular construction system forming a modular construction model here, as an example, in the form of a steamboat.

FIG. 14 schematically illustrates a perspective view of an interactive modular construction element 100 corresponding to the interactive modular construction element 100 of FIG. 10. The interactive modular construction element 100 is shown together with additional exemplary modular construction elements as part of a modular construction system forming a modular construction model here, as an example, in the form of a volcano.

FIG. 15 schematically illustrates a top view of a maximum size of an interactive modular construction element as disclosed herein according to some embodiments.

In some embodiments, the input part 101 and the output part 102 of an interactive modular construction element 100 is of substantially the same size, both in width and in length, but not necessarily in height.

Shown is a construction element 100 that for some embodiments illustrate a maximum size—measured in units of coupling members 402—in relation to two predetermined directions (e.g. width and length) to be 4 (width)×8 (length) coupling members 402 and e.g. both the input part 101 and the output part 102, each to maximally be 4×4. It is noted, that a given construction element need not be the maximum extent everywhere, as readily shown in the other Figures.

Having such a maximum size for interactive modular construction elements 100 is of use in modular construction systems comprising such elements as a (more or less) standardised size or maximum size promotes the modularity. It is to be understood of course, that the interactive modular construction elements can be used with other compatible construction elements of various shapes and sizes.

FIG. 16 schematically illustrates a modular construction system comprising a number of interactive modular construction elements as disclosed herein.

Illustrated is a modular construction system 200 comprising at least two interactive modular construction elements 100 (as disclosed herein and variations thereof) and potentially other compatible modular construction elements of various shapes and sizes.

As mentioned, in some embodiments the construction elements 100 each comprises a wireless communications receiver and/or wireless communications transmitter, e.g. in the form of a communications transceiver, and they are able to wirelessly communicate 400 between them as already disclosed herein. This may e.g. allow a sensor of one construction element 100 to trigger a function of another construction element 100 increasing play value. It may also allow for combinations of sensor signals and/or control signals, e.g. a function of a given construction element 100 is depending on the sensor signals of sensors located in two (or more) different construction elements 100 (e.g. including itself). Effectively, sensor input and/or function output across the interactive modular construction elements are mixed.

FIG. 17 schematically illustrates a data processing system or device, a communications network, and a plurality of interactive modular construction elements forming a modular construction system.

Shown is a data processing system or device 130 having a wireless communications interface and e.g. a graphical user-interface, a plurality of interactive modular construction elements 100 as disclosed herein and having a wireless communications interface, and a communications network 131 allowing the data processing system or device 130 to communicate with other devices e.g. for accessing one or more Internet services. The data processing system or device 130 and the construction elements 100 is adapted to communicate directly and the respective interactive modular construction elements 100 may communicate between them e.g. as shown in FIG. 16 and as disclosed herein.

The construction elements 100 may e.g. form part of a modular construction system as also disclosed herein.

The data processing system or device 130 may be or comprise a suitably programmed computer or other processing device, e.g. a desktop computer, a tablet computer, a smartphone, a laptop computer, or another programmable computing device.

The wireless communication interface may be an integrated communications interface, e.g. a Wifi or Bluetooth interface of a suitably programmed, conventional computer. Alternatively, the wireless communications interface may be a separate communications interface that is connectable to the computer, e.g. via a wired connection, e.g. via a USB port, or wirelessly. It will be appreciated that multiple interactive modular construction elements may be communicatively connected to the data processing system at the same time.

In some embodiments, the data processing system or device 130 has stored thereon a program, e.g. an App, adapted to interact with one or more interactive modular construction elements 100. For example, the data processing system or device 130 may be configured to provide a programming environment allowing a user to generate, edit programs for controlling the behaviour, rules, etc. of one or more interactive modular construction elements. The generated program may be transferred to and stored in a memory and/or storage of the interactive modular construction element 100.

In some embodiments, the data processing system or device 130 may be configured to transmit data and/or information for local storage in one or more interactive modular construction elements 100. Such data and/or information may e.g. comprise user-created content. If e.g. an interactive modular construction element 100 comprises a speaker (e.g. amplified) or the like as a function element, a user could record and download a sound to the interactive modular construction element 100, which then could be played in response to triggering a sensor of the interactive modular construction element 100.

Embodiments of the control circuits of the interactive modular construction elements described herein can be implemented by means of hardware comprising several distinct elements, and/or at least in part by means of a suitably programmed microprocessor.

In the claims enumerating several means, several of these means can be embodied by one and the same element, component or item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, elements, steps or components but does not preclude the presence or addition of one or more other features, elements, steps, components or groups thereof.

The invention claimed is:

1. An interactive modular construction element for a modular construction system, the interactive modular construction element having an input part defining a first end of the interactive modular construction element and an output part defining a second end, the first end opposite the second end such that the input and output parts are visually distinguishable from each other, the interactive modular construction element comprising:

an integrated sensor situated within the input part of the interactive modular construction, the integrated sensor being responsive to a predetermined sensor input and adapted to output a sensor signal corresponding to or representing the predetermined sensor input, an integrated function element situated within the output part of the interactive modular construction, across the interactive modular construction element from the integrated sensor, the integrated function element adapted to perform at least one controllable function in response to a control signal, and an integrated control circuit connected to the integrated sensor to receive the sensor signal and connected to the integrated function element to provide the control signal, wherein:

the integrated control circuit is adapted to provide the control signal in response to the sensor signal thereby controlling the integrated function element in response to the sensor signal;

the interactive modular construction element further comprises a wireless communications receiver connected to the integrated control circuit;

the integrated control circuit is further adapted to modify the control signal in response to one or more external control signals received via the wireless communications receiver from one or more external interactive modular construction elements, thereby modifying the at least one controllable function of the integrated function element; and at least one of the one or more external control signals is provided in response to a sensor signal of an integrated sensor of the one or more external interactive modular construction elements.

2. The interactive modular construction element according to claim 1, wherein the input part takes up a first predetermined portion of the interactive modular construction element in a first predetermined direction and the output part takes up a second predetermined portion at an opposite end of the interactive modular construction element in the first direction.

3. The interactive modular construction element according to claim 2, wherein both the first and the second predetermined portion of the interactive modular construction element each are 50% of an extent of the interactive modular construction element in the first predetermined direction.

4. The interactive modular construction element according to claim 1, wherein the input part comprises one or more user input and/or operation elements, located on a top of the input part.

5. The interactive modular construction element according to claim 1, wherein the input part has a first color and the output part has a second color, where the first color is distinctly different to the second color.

6. The interactive modular construction element according to claim 1, wherein the input part comprises a first number of coupling members located at a same first level and/or the output part comprises a second number of coupling members located at a same second level wherein the first number and/or the second number of coupling members is at least five or at least six.

7. The interactive modular construction element according to claim 1, further comprising an integrated wireless communications transmitter connected to the integrated control circuit, and wherein the integrated control circuit is further adapted to supply the sensor signal and/or the control signal as an external control signal to one or more interactive modular construction elements.

8. The interactive modular construction element according to claim 1, further comprising one or more of:

the input part comprises one or more visual indicators and/or has a shape adapted to communicate visually to a user what type of integrated sensor is comprised by the interactive modular construction element, and the output part comprises one or more visual indicators and/or has a shape adapted to communicate visually to a user what type of function is carried out by the integrated function element of the interactive modular construction element.

9. The interactive modular construction element according to claim 1, wherein the integrated sensor and the integrated function element are selected from the group consisting of:

a motion, movement sensor or tilt sensor and a speaker, buzzer, or sound generator as a function element, a proximity sensor and a motor as a function element, a tacho sensor and a motor as a function element, a sound registration sensor or sound level sensor and a display element as a function element, and a sound registration sensor or sound level sensor and a motor as a function element.

10. The interactive modular construction element according to claim 1, wherein the interactive modular construction element is divided across a predetermined first direction into the input part and the output part.

11. The interactive modular construction element according to claim wherein the interactive modular construction element comprises an integrated memory having stored therein control or program code associating respective output behaviours to different control signals.

12. The interactive modular construction element according to claim 1, wherein the integrated wireless communications receiver includes an integrated wireless communications transceiver.

13. The interactive modular construction element according to claim 7, wherein the integrated wireless communications receiver includes an integrated wireless communications transceiver.

14. A modular construction system comprising:

two or more interactive modular construction elements, wherein the two or more interactive construction elements each includes;

an integrated input pan being responsive to a predetermined sensor input, the integrated input part defining a first end of the respective interactive modular construction element, an integrated output part being adapted to perform at least one controllable function, the integrated output part defining a second end opposite the first end such that the integrated input and output parts are visually distinguishable from each other, and an integrated wireless communications transceiver, wherein:

an output of the integrated output part of a first interactive construction element of the two or more interactive construction elements is configured to be controllable responsive to an input received by the integrated input part of the first interactive construction element, the output of the integrated output part of the first interactive construction element is configured to be controllable responsive to an input received by the integrated input part of a second interactive construction element of the two or more interactive construction elements, and the integrated wireless communications transceivers of the first interactive construction element and the second interactive construction element are configured to transfer information relating to the input received by the integrated input part of the second interactive construction element from the second interactive construction element to the first interactive construction element.

15. The modular construction system according to claim 12, wherein at least one of the two or more interactive modular construction elements is configured for transmitting a sensor signal or a control signal to other interactive modular construction elements within communication range.

16. The modular construction system according to claim 15, wherein:

at least two of the two or more interactive modular construction elements are configured for detecting the presence of each other within communication range, and wherein each of the at least two of the two or more interactive modular construction elements are further configured for transmitting the sensor signal or the control signal to selected ones of the detected interactive modular construction elements.

17. The modular construction system according to claim 14, wherein at least one of the two or more interactive modular construction elements is configured for transmitting a broadcast message including an identifier of the transmitting interactive modular construction element and/or one or more identifiers of ono or more target receiving interactive modular construction element and/or further information allowing a receiving interactive modular construction element to selectively react to a broadcast message.

18. The modular construction system according to claim 14, wherein each of the two or more interactive modular construction elements comprises an integrated memory having stored therein control or program code associating respective output behaviours to different control signals where the control signals are received from the integrated input part of the interactive modular construction element and/or from another interactive modular construction element.

19. The modular construction system according to claim 18, wherein the stored control or program code associates respective output behaviours in response to a combination of control signals.

20. The modular construction system according to claim 19, wherein the combination of control signals comprises a combination of a control signal received from the integrated input part of the interactive modular construction element and a control signal received from respective one or more integrated input parts of one or more other interactive modular construction elements.

21. The modular construction system according to claim 14, wherein the two or more interactive modular construction elements are toy and/or educational modular construction elements for a toy and/or educational modular construction system.

22. A system of interactive toy bricks comprising:

a first toy brick having an input part, defining a first end of the first toy brick and an output part defining a second end of the first toy brick, the first end opposite the second end such that the input and output parts are visually distinguishable from each other, the first toy brick including:

a first toy brick integrated sensor configured to output a first sensor signal, the integrated sensor situated within the input part of the first toy brick;

a first toy brick integrated function element configure to perform a controllable function in response to a first control signal, the integrated function element situated within the output part of the first toy brick; and a first toy brick integrated control circuit in communication with the first toy brick integrated sensor to receive the sensor signal, the first toy brick integrated control circuit also in communication with the first toy brick integrated function element to provide the first control signal; and a second toy brick having an input part defining a first end of the second toy brick and an output part defining a second end of the second toy brick, the first end opposite the second end such that the input and output parts are visually distinguishable from each other, the second toy brick including:

a second toy brick integrated sensor configured to output a second sensor signal, the integrated sensor situated within the input part of the second toy brick;

a second toy brick integrated function element configure to perform a controllable function in response to a second control signal, the integrated function element situated within the output part of the second toy brick; and a second toy brick integrated control circuit in communication with the second toy brick integrated sensor to receive the second sensor signal, the second toy brick integrated control circuit also in communication with the second toy brick integrated function element to provide the second control signal, wherein the first toy brick integrated control circuit is configured to modify the first control signal in response to the second sensor signal.

23. The system of interactive toy bricks according to claim 22, wherein the first and second toy brick each have a respective integrated wireless communications receiver and transceiver.

24. The system of interactive toy bricks according to claim 22, wherein the first and second toy brick each have a respective integrated memory having stored therein control or program code associating respective output behaviours to different control signals.

* * * * *